United States Patent [19]

Knapp et al.

[11] 4,425,887

[45] Jan. 17, 1984

[54] APPARATUS FOR REGULATING THE IDLING RPM OF AN INTERNAL COMBUSTION ENGINE

[75] Inventors: Heinrich Knapp, Leonberg; Rainer Schillinger, Stuttgart, both of Fed. Rep. of Germany

[73] Assignee: Robert Bosch GmbH, Stuttgart, Fed. Rep. of Germany

[21] Appl. No.: 364,112

[22] Filed: Mar. 30, 1982

[30] Foreign Application Priority Data

Apr. 7, 1981 [DE] Fed. Rep. of Germany ..... 3113986

[51] Int. Cl.[3] ..... F02M 7/12

[52] U.S. Cl. ..... 123/339; 123/587

[58] Field of Search ..... 123/339, 585, 587, 588

[56] References Cited

U.S. PATENT DOCUMENTS 4,325,349 4/1982 Fehrenbach ..... 123/587

4,344,398 8/1982 Ikeura ..... 123/339

FOREIGN PATENT DOCUMENTS 2940237 4/1981 Fed. Rep. of Germany ..... 123/339

*Primary Examiner*—William A. Cuchlinski, Jr.

*Attorney, Agent, or Firm*—Edwin E. Greigg

[57] ABSTRACT

An apparatus is proposed which serves to regulate the idling rpm of an internal combustion engine. To this end, a bypass valve is provided, which is disposed in a bypass around a throttle valve in the intake tube of the engine. A movable wall of the bypass valve separates a control chamber from a bypass chamber. The intake tube pressure downstream of the throttle valve in the bypass chamber prevails. The control chamber communicates via a control throttle restriction with atmospheric pressure and also, via an electromagnetically actuatable control valve which operates in accordance with operating characteristics of the engine, as well as with the intake tube pressure downstream of the throttle valve. The regulation of the idling rpm is thus effected by means of a proportional component effected by the bypass valve and an integral component effected by the pressure distribution between the control throttle restriction and the control valve. A pilot valve or magnetic pilot valve, by effecting a brief opening of the bypass valve, serves to prevent the loaded engine from stalling in the event of an abrupt closure of the throttle valve.

6 Claims, 3 Drawing Figures

APPARATUS FOR REGULATING THE IDLING RPM OF AN INTERNAL COMBUSTION ENGINE

BACKGROUND OF THE INVENTION

The invention is based on an apparatus for regulating the idling rpm of an internal combustion engine as generally described by the preamble to the main claim. An apparatus of this kind is already known, but in which the electromagnetically actuatable control valve for opening the bypass valve must be designed for the entire range of regulation, and to achieve this, a very large electromagnet is required, which is therefore expensive and consumes a large amount of electric current.

OBJECT AND SUMMARY OF THE INVENTION

The apparatus according to the invention for regulating the idling rpm of an internal combustion engine, having the characteristics of the main claim, has the advantage over the prior art that the bypass valve independently acts as a proportional regulator, superimposed on which is an integral regulator embodied by the control throttle restriction and the electromagnetically actuatable control valve. As a result, the control valve needs to be designed only for a small regulation range, which reduces the triggering output and requires only a small control valve.

As a result of the characteristics disclosed in the dependent claims, advantageous further embodiments of and improvements to the apparatuses [sic] disclosed in the main claim are attainable.

It is particularly advantageous to provide a pilot valve, which when the throttle valve closes causes a brief opening of the bypass valve; this prevents the engine from stalling under load.

The invention will be better understood and further objects and advantages thereof will become more apparent from the ensuing detailed description of two preferred embodiments taken in conjunction with the drawings.

DESCRIPTION OF THE PREFERRED EMBODIMENTS

Figure 1:
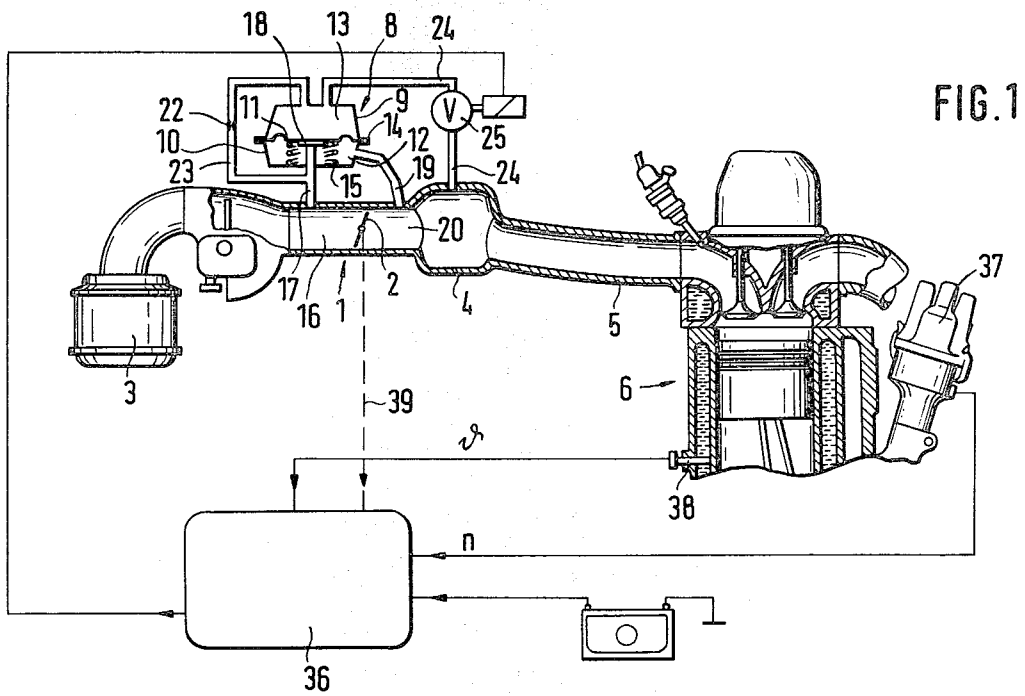
FIG. 1 shows the first exemplary embodiment of an apparatus for regulating the idling rpm of an internal combustion engine.

In the first exemplary embodiment of an apparatus for regulating the idling rpm of an internal combustion engine as shown in FIG. 1, a throttle valve 2 is disposed in an intake tube 1. Upstream of the throttle valve 2, there is an air filter 3, and downstream of the throttle valve 2 the intake tube 1 leads via a manifold section 4 and individual intake tubes 5 to each of the cylinders 6 of the engine. A bypass valve 8 serves to regulate the idling rpm. Also, the bypass valve 8 has a housing comprising two housing parts 9 and 10, and the housing is divided by a movable wall embodied as a diaphragm 11 into a bypass chamber 12 and a control chamber 13. The diaphragm 11 is held firmly in place on the crimped rim 14 connecting the two housing parts 9, 10. A compression spring 15 is supported at one end on the bottom of the housing part 10 and on the other end on the diaphragm 11. Beginning at an intake tube section 16 upstream of the throttle valve 2, a first bypass line 17 leads to a fixed valve seat 18, which protrudes into the bypass chamber 12 and with which the diaphragm 11, as a movable valve element, cooperates. When the bypass valve 8 is open, air is thus capable of flowing from the intake tube section 16 via the first bypass line 17 and the fixed valve seat 18 into the bypass chamber 12, and from there via a second bypass line 19 to an intake tube section 20 downstream of the throttle valve or into the manifold section 4.

Figure 3:
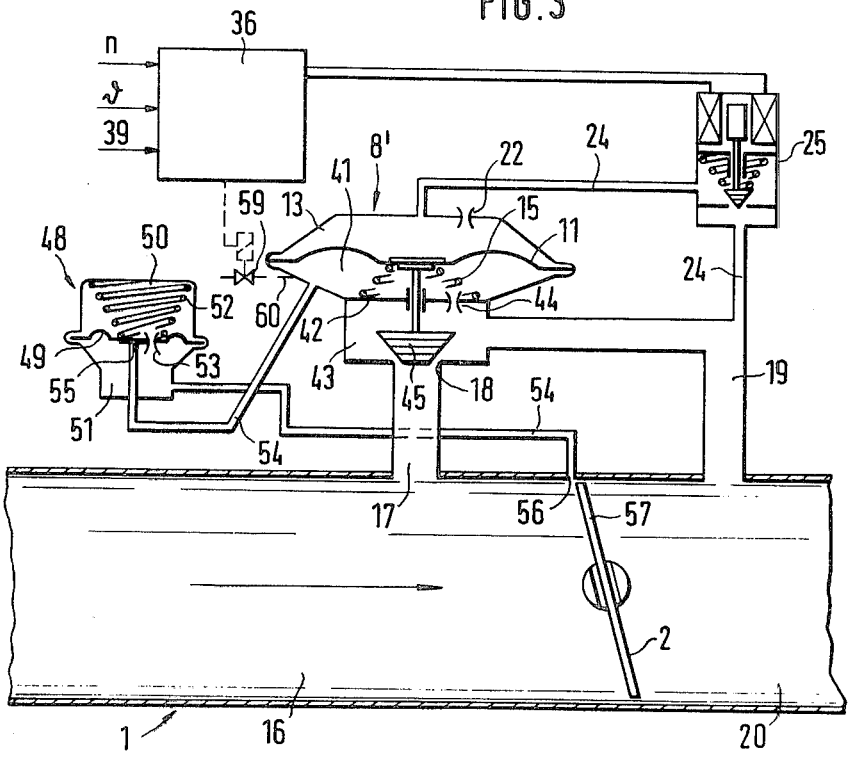
FIG. 3 shows a second exemplary embodiment of an apparatus for regulating the idling rpm of an internal combustion engine.

The control chamber 13 of the bypass valve 8 may communicate with the atmosphere via a control throttle restriction 22, as shown in FIG. 3, or an atmospheric-pressure line 23 may be provided, as shown in FIG. 3, which branches off from the first bypass line 17 and leads to the control chamber 13 and in which the control throttle restriction 22 is disposed. Thus air is capable of flowing from upstream of the throttle valve 2 via this atmospheric-pressure line 23 at virtually atmospheric pressure. The control chamber 13 also communicates with the manifold section 4 or the intake tube section 20 downstream of the throttle valve 2 by way of a control line 24. An electromagnetically actuatable control valve 25 is disposed in the control line 24 and is triggerable in accordance with operating conditions of the engine. The control valve 25 may be triggered in a clocked manner or may operate on the principle of the nozzle/impact plate, thus regulating a pressure difference. In the non-excited state, the control valve 25 should be closed, so that virtually atmospheric pressure is established in the control chamber 13 and the bypass valve 8 is kept closed. The triggering of the electromagnetic control valve 25 is effected in a manner known per se by an electronic control unit 36, to which pulses are delivered from the ignition distributor 37 for ascertaining the rpm r of the engine and to which a temperature signal $\theta$ is also delivered from a temperature probe 38 in the engine coolant. The electronic control unit 36 can also be supplied with a signal 39 from a so-called throttle valve switch, which is embodied by way of example as a limit switch and furnishes a signal characterizing the idling position of the throttle valve.

Figure 2:
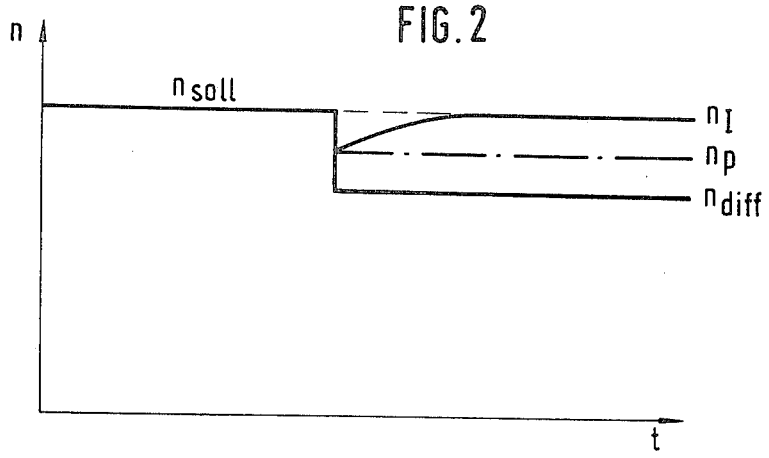
FIG. 2 is a diagram showing the behavior over time of the apparatus according to the invention.

The mode of operation of the apparatus shown in FIG. 1 will now be described with the aid of the diagram of FIG. 2, in which the rpm is plotted as n on the ordinate and the time is plotted as t on the abscissa. If when the throttle valve is closed, a set-point idling rpm $n_{soll}$, which is dependent on the temperature $\theta$, drops to an rpm $n_{diff}$, then the bypass valve 8 opens as a consequence of the increased intake tube pressure established in the bypass chamber 12 via the second bypass line 19 and thus, acting as a proportional regulator, regulates an rpm $n_p$, which however is still below the set-point idling rpm $n_{soll}$. At the same time, the control valve 25 is triggered by the electronic control unit 36, forming together with the control throttle restriction 22 an integral regulating circuit; as a result, a control pressure is produced in the control chamber 13 which is between atmospheric pressure and the intake tube pressure downstream of the throttle valve 2. The bypass valve 8 accordingly continues to remain open until such time as the idling rpm has attained the set-point idling rpm $n_{soll}$, taking the course described by the line $n_I$.

In the exemplary embodiment shown in FIG. 3 of an apparatus for regulating the idling rpm of an internal combustion engine, the elements remaining the same as and functioning like those of FIG. 1 are identified by the same reference numerals.

The diaphragm 11 separates the control chamber 13 from a first bypass chamber 41, which is separated from a second bypass chamber 43 by a partition 42. The compression spring 15 is disposed in the first bypass chamber 41 and is supported on one end on the diaphragm 11 and on the other on the partition 42. The second bypass line 19 leads from the second bypass chamber 43 to the intake tube downstream of the throttle valve 2. The first bypass chamber 41 and the second bypass chamber 43 communicate with one another by means of a bypass throttle restriction 44. The movable valve element 45, embodied in conical fashion by way of example, is connected with the diaphragm 11, passing through the partition 42 and cooperating with the fixed valve seat 18.

The mode of operation of the apparatus as described so far corresponds to that of the apparatus shown in FIG. 1.

In addition, the exemplary embodiment of FIG. 3 is provided with a pilot valve 48, whose valve diaphragm 49, acting as the movable valve element, separates a compensation chamber 50 from a pilot chamber 51. A closing spring 52 is disposed in the compensation chamber 50, being supported on the valve diaphragm 49 and urging the pilot valve 48 in the closing direction. The compensation chamber 50 communicates with the pilot chamber 51 via a pilot throttle 53. A pilot conduit 54 leads from the intake tube 16 directly upstream of the throttle valve 2 to the pilot chamber 51 and from there via a fixed valve seat 55 to the first bypass chamber 41. The opening 56 of the pilot conduit 54 toward the intake tube section 16 is located directly upstream of the throttle valve vane 57, which upon an opening movement of the throttle valve 2 opens counter to the air flow, so that even if there is a small opening movement of the throttle valve 2, the opening 56 will be located downstream of the throttle valve vane 57. In this state, the same intake tube pressure prevails in the pilot chamber 51 and the compensation chamber 50 as downstream of the throttle valve 2. Now if the throttle valve 2 is abruptly closed, then the opening 56 moves to a position upstream of the throttle valve 2, and the air pressure upstream of the throttle valve 2 is established in the pilot chamber 51, this pressure being virtually equal to atmospheric pressure. As a result, the valve diaphragm 49 is lifted from the fixed valve seat 55, so that again, via the fixed valve seat 44, the intake tube pressure upstream of the throttle valve 2 is established in the first bypass chamber 41 of the bypass valve 8', and the diaphragm 11 executes a movement in which the movable valve element 45 is lifted from the fixed valve seat 18, so that supplementary air can flow from the first bypass line 17 to the second bypass line 19 downstream of the throttle valve 2 in order to assure a sufficiently high idling rpm. As a result, engine stalling in the event of a sudden closure of the throttle valve and a simultaneous load on the engine is prevented. As soon as a sufficiently great pressure compensation has been effected in the compensation chamber 50 via the pilot throttle 53, the pilot valve 48 closes, and after the pressure in the first bypass chamber 41 has been compensated via the bypass throttle restriction 44, the bypass valve 8' also closes, so long as the rpm is not lower than the set-point idling rpm.

In place of the pilot control box 48, a magnetic pilot valve 59 may also be provided, as indicated by broken lines. This magnetic pilot valve 59, triggerably by the electronic control unit 36, then briefly opens a line 60 leading from the atmosphere to the first bypass chamber 41 of the bypass valve 8', whenever the throttle valve 2 is rotated into the idling position.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An apparatus for regulating the idling rpm of an internal combustion engine having an intake tube in which an arbitrarily actuatable throttle valve is disposed, a bypass valve triggerable in accordance with operating characteristics of said engine associated with said intake tube, said bypass valve having a movable wall which at least defines a control chamber in which a control pressure prevails, said control pressure being capable of being influenced by an electromagnetically actuatable control valve, characterized in that said bypass valve further included a fixed valve seat engaging a supporting spring beneath said movable wall opposite said control chamber and communicating with the intake tube pressure downstream of said throttle valve, a first control throttle restriction in said control chamber communicating with atmospheric pressure and a second control throttle restriction in said control chamber communicating with said control valve and the intake tube pressure downstream of said throttle valve.

2. An apparatus as defined by claim 1, characterized in that said movable wall is embodied as a diaphragm.

3. An apparatus as defined by claim 2, characterized in that said diaphragm separates first and second bypass chambers, a partitioned area in said second bypass chamber, said partitioned area arranged to communicate with the intake tube downstream of said throttle valve, said partitioned area further including a bypass throttle restriction and means defining an opening in said diaphragm arranged to receive a movable valve element which cooperates with said fixed valve seat positioned beneath said partitioned area.

4. An apparatus as defined by claim 3, characterized in that said bypass valve includes a line which extends to a terminus in a pilot valve said pilot valve futher including a diaphragm arranged to subdivide said pilot valve into upper and lower chambers, said terminus of said line arranged to cooperate with said diaphragm and another line extending from said second chamber to a means defining an opening in said intake tube downstream thereof.

5. An apparatus as defined by claim 4, characterized in that said pilot valve is arranged to open briefly when there is an abrupt closure of said throttle valve, so that said bypass valve opens in consequence of the pressure increase in said bypass chamber with which it communicates.

6. An apparatus as defined by claim 3, characterized in that said second bypass chamber further includes a line extending to a magnetic pilot valve which is briefly opened upon abrupt closure of said throttle valve and as a consequence said bypass valve also opens, so that engine stalling is prevented.

* * * * *